US007604226B2

(12) United States Patent
Baker

(10) Patent No.: US 7,604,226 B2
(45) Date of Patent: Oct. 20, 2009

(54) METHOD AND APPARATUS FOR REMOVING WASTE SHEETS FROM A SHEET FEED APPARATUS

(75) Inventor: Derick C. Baker, Liberty Lake, WA (US)

(73) Assignee: J&L Group International LLC, Keithville, LA (US)

( * ) Notice: Subject to any disclaimer, the term of this patent is extended or adjusted under 35 U.S.C. 154(b) by 505 days.

(21) Appl. No.: 11/315,919

(22) Filed: Dec. 22, 2005

(65) Prior Publication Data

US 2007/0147874 A1 Jun. 28, 2007

(51) Int. Cl.
*B65H 15/02* (2006.01)

(52) U.S. Cl. ..... 270/52.04; 270/52.06; 270/58.07; 414/789.1; 414/789.3; 414/789.4

(58) Field of Classification Search ..... 270/52.04, 270/52.06, 58.07; 414/789.2, 789.3, 789.4
See application file for complete search history.

(56) References Cited

U.S. PATENT DOCUMENTS 4,312,502 A * 1/1982 Wilt ..... 414/789.2
4,802,808 A * 2/1989 Wolk et al. ..... 414/789.2
4,925,174 A * 5/1990 Bruce et al. ..... 270/52.04
2005/0220580 A1 * 10/2005 Arnold et al. ..... 414/414

FOREIGN PATENT DOCUMENTS

GB 2277078 A * 10/1994

* cited by examiner

*Primary Examiner*—Gene Crawford
*Assistant Examiner*—Leslie A Nicholson, III
(74) *Attorney, Agent, or Firm*—Dorsey & Whitney LLP; Nathan J. Witzany

(57) ABSTRACT

An apparatus and method for removing waste sheets from a sheet feed apparatus, removes waste sheets in a ergonomic manner. The bottom sheet or sheets from a stack of sheets is moved from an input hopper to a waste hopper. An accumulation of sheets in the waste hopper are rotated to an on-end orientation for convenient removal from the sheet feed apparatus. A conveyor may be provided to convey the on-end waste sheet out of the sheet feed apparatus. Sensors and alarms may be provided to modify a user when the waste sheet hopper is full. An interlock mechanism may be provided to prevent waste sheets from being added to the waste sheet hopper when it is full or tilted for sheet removal.

14 Claims, 5 Drawing Sheets

METHOD AND APPARATUS FOR REMOVING WASTE SHEETS FROM A SHEET FEED APPARATUS

FIELD OF THE INVENTION

This invention relates generally to systems for transporting blank sheets of material to a finishing machine, and more particularly to methods and apparatuses for removing waste sheets from a sheet feeding apparatus before the sheets are provided to the finishing machine.

BACKGROUND OF THE INVENTION

The manufacture of boxes and cartons is a highly automated process. As part of the process, blank flat sheets of material, such as paperboard, cardboard, or corrugated cardboard are transported by a feeding apparatus, such as a prefeeder, to a finishing or converting machine. The blank sheets are loaded into the feeding apparatus in large stacks, typically at an input hopper. The feeding apparatus breaks the large stacks of sheets into smaller stacks, may invert some or all of the sheets, and provides the sheets to the converting machine in a useable form, typically a shingled stream. The converting machine may then print, cut, fold, glue, or otherwise perform work on the sheets to make folded boxes, cartons or other items.

Commonly the bottom sheet or sheets of the large stacks will be damaged so that they are unsuitable for use in forming the end product boxes or cartons. More importantly, these damaged bottom sheets may cause material jams in the converting machine. This can lead to a loss in productivity. Therefore, it is desirable to sort out the sheets that were on the bottom of the large stacks before passing the sheets to the converting machine hopper.

One potential solution to the damaged bottom sheet problem has been to remove the bottom sheet or sheets from the conveyor system of the feeding apparatus. These removed sheets have generally been deposited directly on to the floor, or on to a tray or cart that can be pulled manually out of the feeding apparatus. In the past, the removed sheets have been removed from the feeding apparatus in a flat horizontal orientation. This orientation is not advantageous for a user to maneuver and dispose of the waste sheets. It is ergonomically difficult for the user to grasp the sheets when they are lying flat. The flat lying sheets do not slide easily because of the large surface area in contact with the floor, and because a lateral force applied to a stack will tend to cause the sheets to slide off of each other.

Therefore, there is a need for an improved apparatus and method for removing waste sheets from a sheet feeding apparatus.

BRIEF SUMMARY OF THE INVENTION

The present invention, in one embodiment, is a sheet feeding apparatus adapted to remove waste sheets from a supply of sheets The sheet feeding apparatus has a frame including a conveying mechanism for conveying a supply of sheets, a sorting mechanism for sorting waste sheets out of the supply of sheets and conveying the waste sheets to a waste sheet tray, a tilting mechanism for tilting the waste sheet tray to a generally vertical orientation, a waste sheet removal area aligned to receive waste sheets from said waste sheet tray when the waste sheet tray is tilted to said generally vertical orientation, and an access pathway permitting a user to access and remove waste sheets from said sheet removal area. An access cover for selectively covering said access pathway may be provided that includes an interlock to maintain the cover in a covering position unless the waste sheet tray is tilted to the generally vertical orientation. A locking mechanism may be used to prevent the sorting mechanism from conveying the waste sheets to the waste sheet tray when the waste sheet tray is in the generally vertical orientation. An exit conveyor may be used for conveying waste sheets out of the waste sheet removal area through the access pathway. A detector may be used for sensing when the waste sheet tray is full and providing an indication to a user when the waste sheet tray is full. The waste sheet tray may be automatically triggered to tilt to the vertical orientation when the detector senses that the waste sheet tray is full.

Another embodiment of the present invention is a method of removing waste sheets from a supply of sheets in a sheet feeding apparatus by first sorting waste sheets out of a supply of sheets of material within a sheet feeding apparatus. The waste sheets are then accumulated in a stack on a waste sheet tray within the sheet feeding apparatus. The waste sheet tray is then tilted to move the stack of waste sheets to a generally vertical on-edge orientation. The on-edge waste sheets are then removed from the sheet feeding apparatus. The method of removing waste sheets according to claim 9, further comprising conveying the on-edge waste sheets at least partially out of the sheet feeding apparatus before removing the on-edge waste sheets from the sheet feeding apparatus. The conveying step may be performed by an exit conveyor on to which the on-edge waste sheets are dumped by the tilting step. A condition of the waste sheet tray may be sensed and a warning signal may be provided when the waste sheet tray is full. The sorting of waste sheets may be prevented when the waste sheet tray is tiled to a generally vertical orientation.

According to yet another embodiment, the present invention is a waste sheet removal mechanism for removing waste sheets from a prefeeder. The waste sheet removal mechanism includes a tilting mechanism for tilting the waste sheets to an on-end orientation such that they may be removed from the prefeeder in the on-end orientation. The tilting mechanism may include a waste sheet tray having a generally horizontal orientation for accumulating the waste sheets and a generally vertical orientation for dumping any accumulated waste sheets in the on-end orientation. An actuator may be provided for moving the waste sheet tray between the generally horizontal orientation and the generally vertical orientation about a pivot axis. An exit conveyor may be included for conveying the waste sheets at least partially out of the prefeeder. The exit conveyor may be located below and adjacent to the pivot axis, such that when the waste sheet tray is pivoted to the substantially vertical orientation, any accumulated waste sheets are dumped on to the exit conveyor in an on-end orientation.

While multiple embodiments are disclosed, still other embodiments of the present invention will become apparent to those skilled in the art from the following detailed description. As will be apparent, the invention is capable of modifications in various obvious aspects, all without departing from the spirit and scope of the present invention. Accordingly, the drawings and detailed description are to be regarded as illustrative in nature and not restrictive.

DETAILED DESCRIPTION

Figure 1:
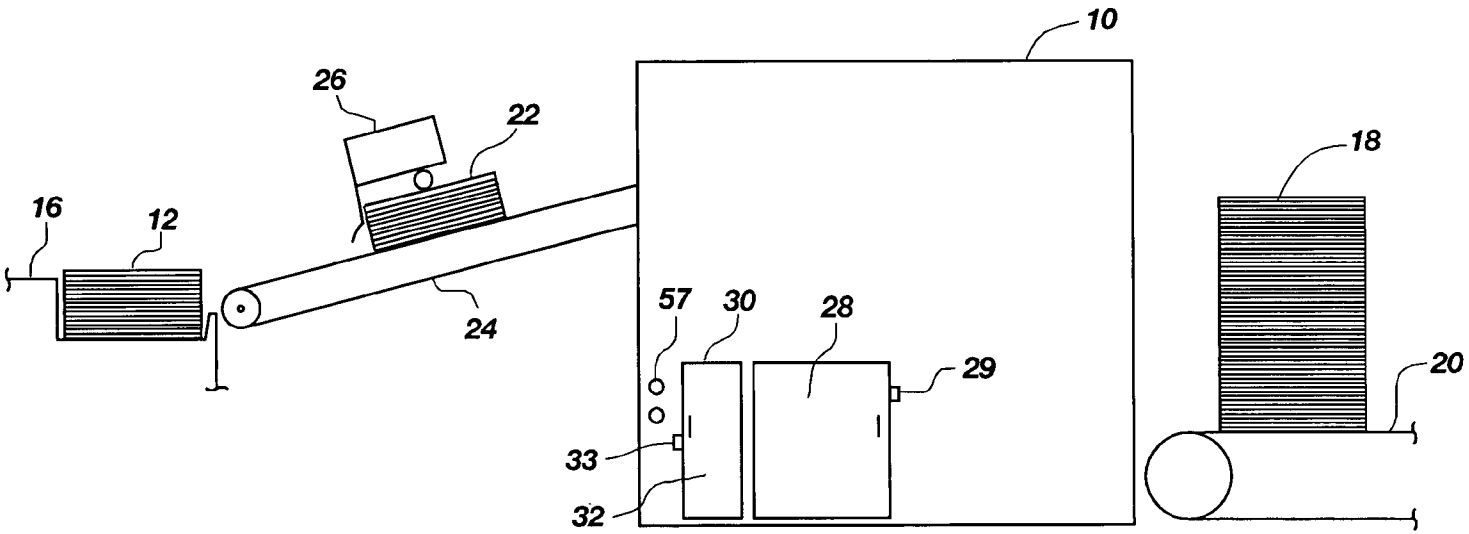
FIG. 1 is a side elevation schematic showing a prefeeder according to one embodiment of the present invention in place in a sheet feed system.

FIG. 1 shows one embodiment of a sheet feeding apparatus 10, sometimes referred to as a prefeeder, according to one embodiment of the present invention. The primary function of the prefeeder 10 is to provide blank sheets 12 to the input hopper 14 of a finishing machine 16. The sheets 12 are loaded into the prefeeder 10 in large stacks 18. In the embodiment shown in FIG. 1, a conveyor 20 is used to convey the large stacks 18 directly into the prefeeder 10. Other mechanisms for loading the large stacks 18 into the prefeeder 10 may be used without departing from the invention. The prefeeder 10 provides small stacks 22 of the sheets 12 to an output conveyor 24 in a fashion that is described in more detail below. A separating apparatus 26 of conventional design is used in combination with the output conveyor 24 to provide the sheets 12 to the input hopper 12 in a shingled stream. From there, the finishing machine 16 can be used to print, cut, hold, or perform other operations on the blank sheets, for example to form a folded box or carton.

The sheets 12 may be any stock material that is provided in flat sheets, such as paper, paperboard cardboard, corrugated cardboard, and the like. The present invention is especially useful for any materials that are prone to having the bottom sheet or sheets in the large stacks 18 damaged such that they are not suitable for use in the finishing machine 16.

The prefeeder 10 includes an access door 28 to provide a user access to the inner workings of the prefeeder 10, especially in case it should be necessary to clear any jams within the system. The access door 28 is preferably hinged to an outer cabinet of the prefeeder 10. The access door 28 may be provided with a window, or may be formed with screen mess so that a user can see inside the prefeeder 10 to determine the status of materials inside the prefeeder 10. The access door 28 may be connected with a switch 29, or similar device that will shut down operation of the prefeeder 10 when the door 28 is opened, as a safety precaution. Alternatively, the access door 28 could be connected to an interlock that will prevent the door from being opened when the prefeeder is running, such that a user would be required to shut down the prefeeder before opening the access door 28.

A waste sheet access opening 30 is covered by a waste sheet access door 32. Preferably the waste sheet access door is hinged to the cabinet of the prefeeder 10. The waste sheet access door 32 may be opened to permit removal of waste sheets from the prefeeder 10. The waste sheet access door 32 may be provided with a window, or may be formed from a screen mess such that a user may see inside to determine when a sufficient quantity of waste sheets have accumulated that need to be removed from the prefeeder 10. The waste sheet access door 32 may be connected with a switch 33 or similar interlock device to prevent it from being opened when conditions are not safe.

Figure 2:
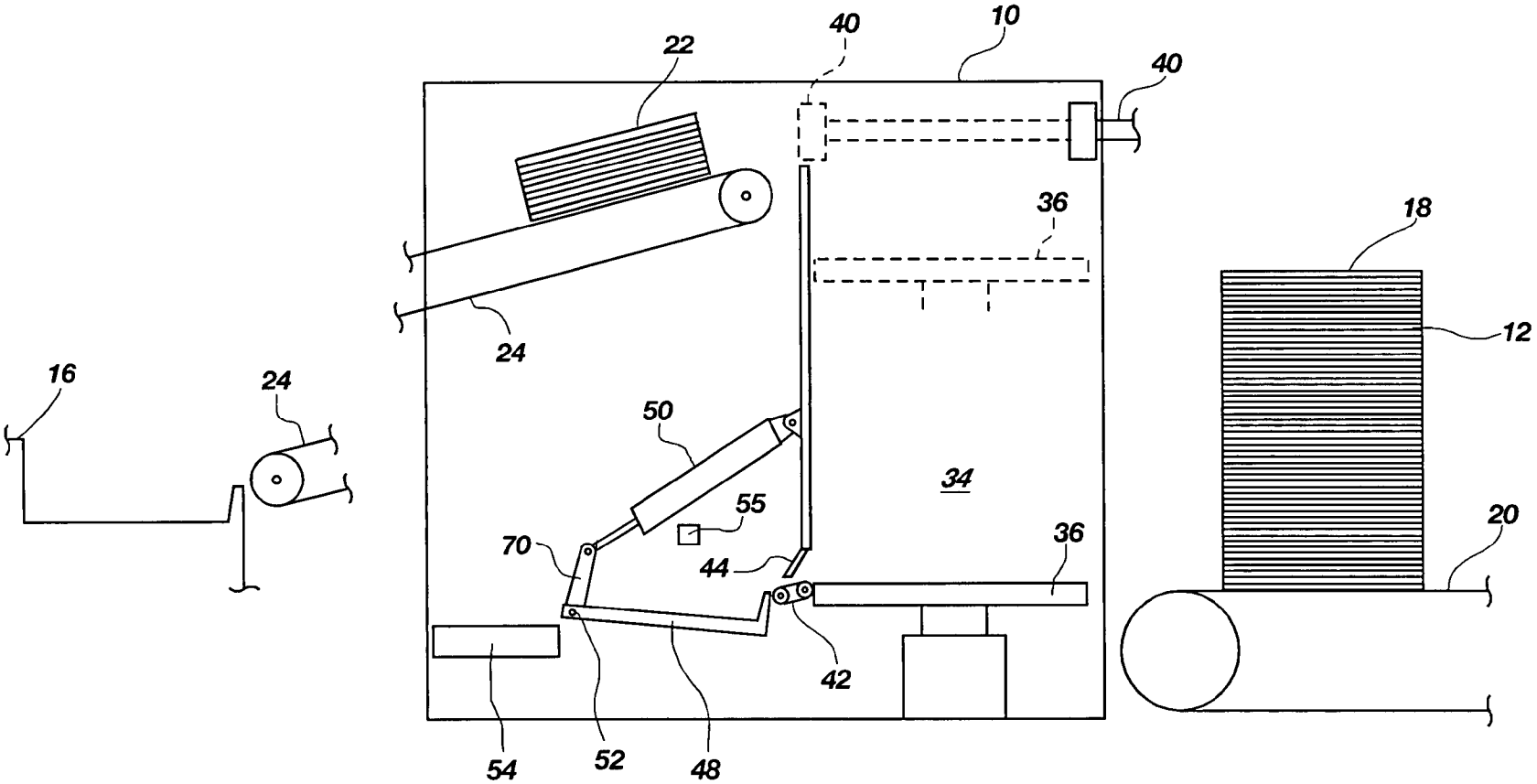
FIG. 2 is a side elevation schematic of the sheet feed system of FIG. 1 with the internal workings of the prefeeder visible.

FIG. 2 shows a schematic view of the inner-workings of the prefeeder 10. A loading area 34 is provided to receive the sheets of material in a large stack 18. A lift platform 36 within the loading area 34 receives the large stacks 18 as they are loaded into the prefeeder by the conveyor 20. The lift platform 36 may be raised and lowered by an actuator system (not shown). In particular, the lift platform 36 may be raised to lift a desired portion of the stack 18 above a gate 38 that is proximate to the loading end of output conveyor 24. A push rod 40, which may be a hydraulic actuator, is positioned such that it can be extended to push off a portion of the large stack 18 extending above gate 38 onto conveyor 24 as a small stack 22 of sheets 12. Those of skill in the art will be aware of other mechanisms for transferring small stacks 22 of sheets to the output conveyor 24, including mechanisms that flip or transpose the sheets 12.

The push rod 40 may be withdrawn after pushing a small stack onto the output conveyor 24, and the lift platform 36 can be further raised to extend to the an additional desired amount of sheets in stack 18 above gate 38. The process may be timed so that small stacks 22 of sheets 12 are provided to the separating apparatus 26 at an appropriate rate to provide a steady stream of sheets 12 to the finishing machine hopper 14. The gate 38 and lift platform 36 are configured such that the bottom most sheet or sheets, typically one or two, but optionally more, are retained behind the gate 38 and do not get passed on to the output conveyor 24. These remaining sheets are waste sheets that need to disposed of because they are commonly damaged and not suitable for use in the finishing machine 16. A waste sheet removal mechanism 37 is provided adjacent to the lift platform 36 to remove these waste sheets from the prefeeder 10.

As part of the waste sheet removal mechanism, a sorting mechanism in the form of sorting conveyor 42 is provided near the bottom of the loading area 34. A retractable gate 44 may be positioned between the loading area and the sorting conveyor 42 to retain the sheets 12 in the loading area 34. When the gate 44 is retracted it permits sheets 12 to pass from the loading area 34 to the waste sheet area 46. In the embodiment shown in FIG. 2, the waste sheet area 46 is located generally towards the finishing machine 16 side of the loading area 34; however, the waste sheet area 46 could optionally be located laterally with respect to the loading area 34.

Figure 6:
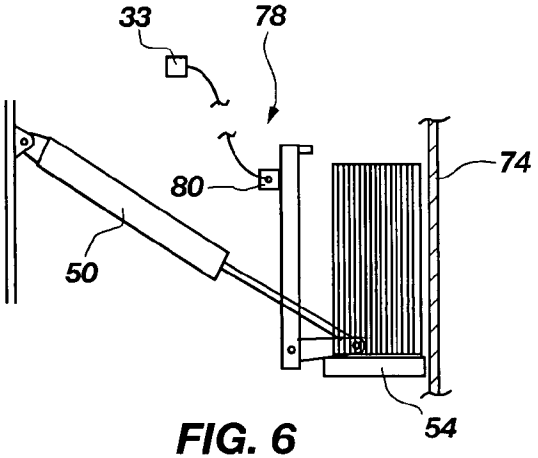
FIG. 6 is a partial side elevation view of the sheet removal mechanism of FIG. 5 with the waste sheet tray adjusted to a raised vertical orientation.

A waste sheet tray 48 is pivotally mounted within the waste sheet area 46. A hydraulic actuator 50 acts as a tilting mechanism to rotate the waste sheet tray 48 about a pivot axis 52 between the normal generally horizontal position of FIG. 2 to a generally vertical position as shown in FIG. 6. In the embodiment of FIG. 2, an exit conveyor 54 is provided proximate to and slightly below the pivot axis 52 within the waste sheet area 46. The exit conveyor 54 should be located such that when the waste sheet tray 48 is tilted to the vertical orientation shown in FIG. 6 any waste sheets 12 contained on the waste sheet tray 48 will be placed, or dumped, on to the exit conveyor 54 in a generally vertical on-edge orientation.

A sensor 55 is provided within the waste sheet area 37 for sensing the amount of waste sheets that have accumulated on the waste sheet tray 48. The sensor 55 may take the form of an optical sensor or other proximity sensor that measures the height of the waste sheets 12 within the waste sheet tray. Alternatively, the sensor 55 may be a mechanical switch or an optical beam that is triggered when the sheets within the tray reach the sensor. As a further alternative, the sensor 55 may be a strain gauge that measures the weight of the waste sheets 12 within the waste sheet tray 48. The sensor 55 may be connected with a notification device 57, such as an indicator light, or an audible alarm, that alerts a user when the waste sheet tray 48 is full.

Figure 3:
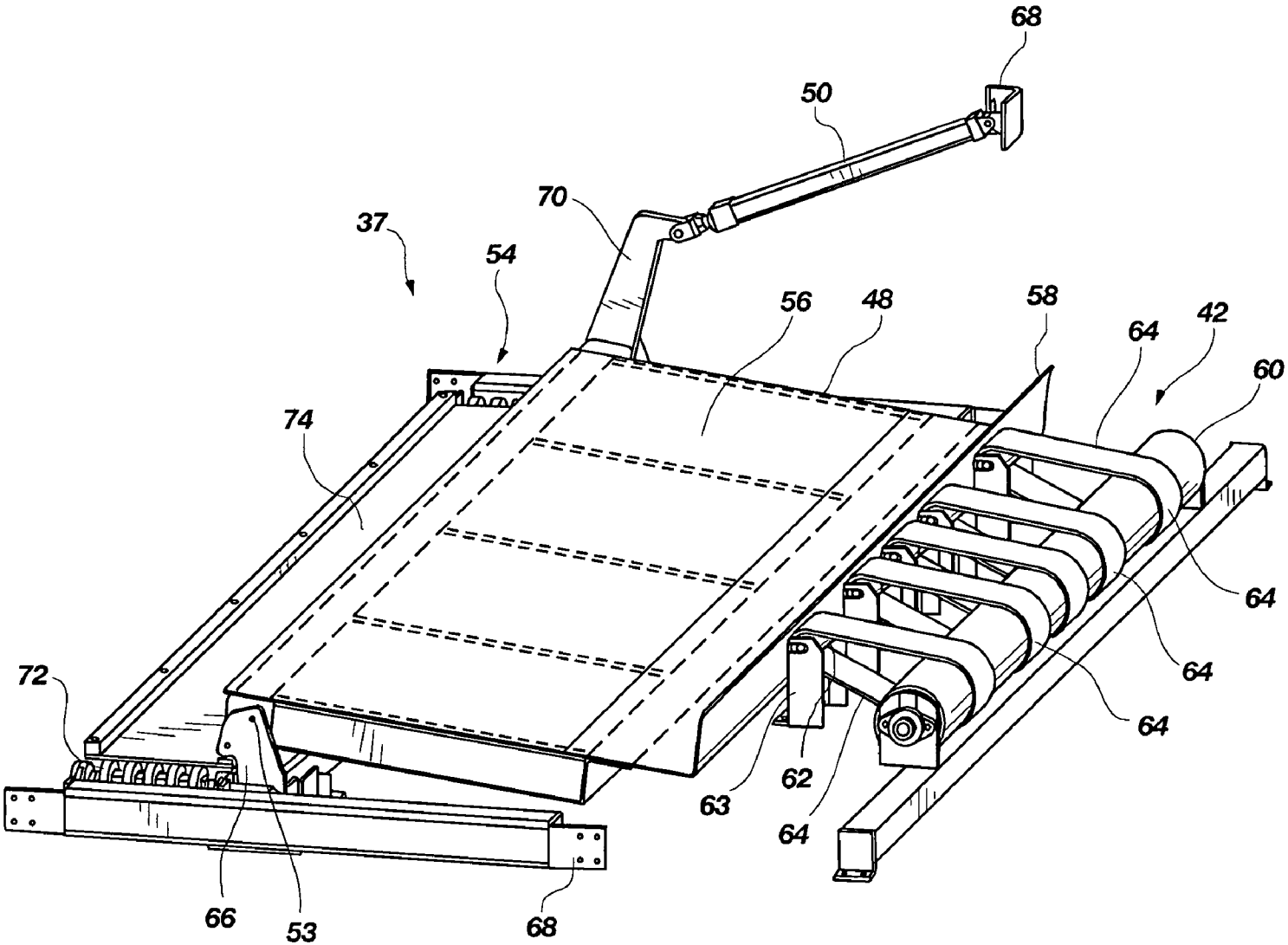
FIG. 3 is an isometric view of the waste sheet removal mechanism from the prefeeder of FIG. 2.

Additional details of a preferred embodiment for the waste sheet removal mechanism 37 can be seen in FIG. 3. The waste sheet tray 48 includes a support surface 56 and a retaining lip 58. The retaining lip 58 is provided generally along the edge of the waste sheet tray 48 that is proximate to the sorting conveyor 42. In the normal, generally horizontal orientation shown in FIG. 3, the support surface 56 slops downwardly towards the retaining lip 58 at a slight angle in order to urge the sheets 12 into a resting position supported by the retaining lip 58. The sorting conveyor 42 comprises a single driven roller 60 and a plurality of passive rollers 62. The passive rollers are mounted on support brackets 63. A plurality of continuous loop belts 64 loop around the driven roller 60 and the passive rollers 62. The spacing between the passive roller 60 and the driven rollers 62 may be variable in order to maintain proper tension in the belt 64, as is commonly known. The top run of the belts 64 should be located slightly above the top edge of the retaining lip 58 when the waste sheet tray 48 is in its resting generally horizontal orientation.

The waste sheet tray 48 is pivotal about a pivot member 53 provided through a brace 66 mounted to a portion of the prefeeder frame 68. A pivot arm 70 extends in a direction generally normal to the support surface 56 near the pivot axis 52. Hydraulic actuator 50 extends between the prefeeder frame 68 and the free end of pivot arm 70. When the actuator 50 is in its shortened non-actuated position, as shown in FIG. 3, the support surface 56 of the waste sheet tray 48 is in a generally upwardly facing orientation to support waste sheets 12 lying flat. As described above, a slight slope in the support surface 56 towards the retaining lip 58 may be desired in this rest position. If the actuator 70 is extended, it will press against the pivot arm 70, causing the tray 48 to rotate towards the tilted upright orientation of FIG. 6.

With further reference to FIG. 3, it can be seen that the exit conveyor 54 is located generally adjacent to and below the pivot axis 52. Exit conveyor rollers 72 support an exit conveyor belt 74 that has been cut-away partially in FIG. 3 to reveal the rollers 72. The rollers can be selectively caused to rotate in order to move belt 74 around the rollers 72 in a direction towards the waste sheet access opening 30. Therefore, sheets 12 that have been dumped onto the conveyor belt 74 will be conveyed out through the access opening 30 upon activation of the exit conveyor 54 when the waste sheet access door 32 is open.

Figure 4:
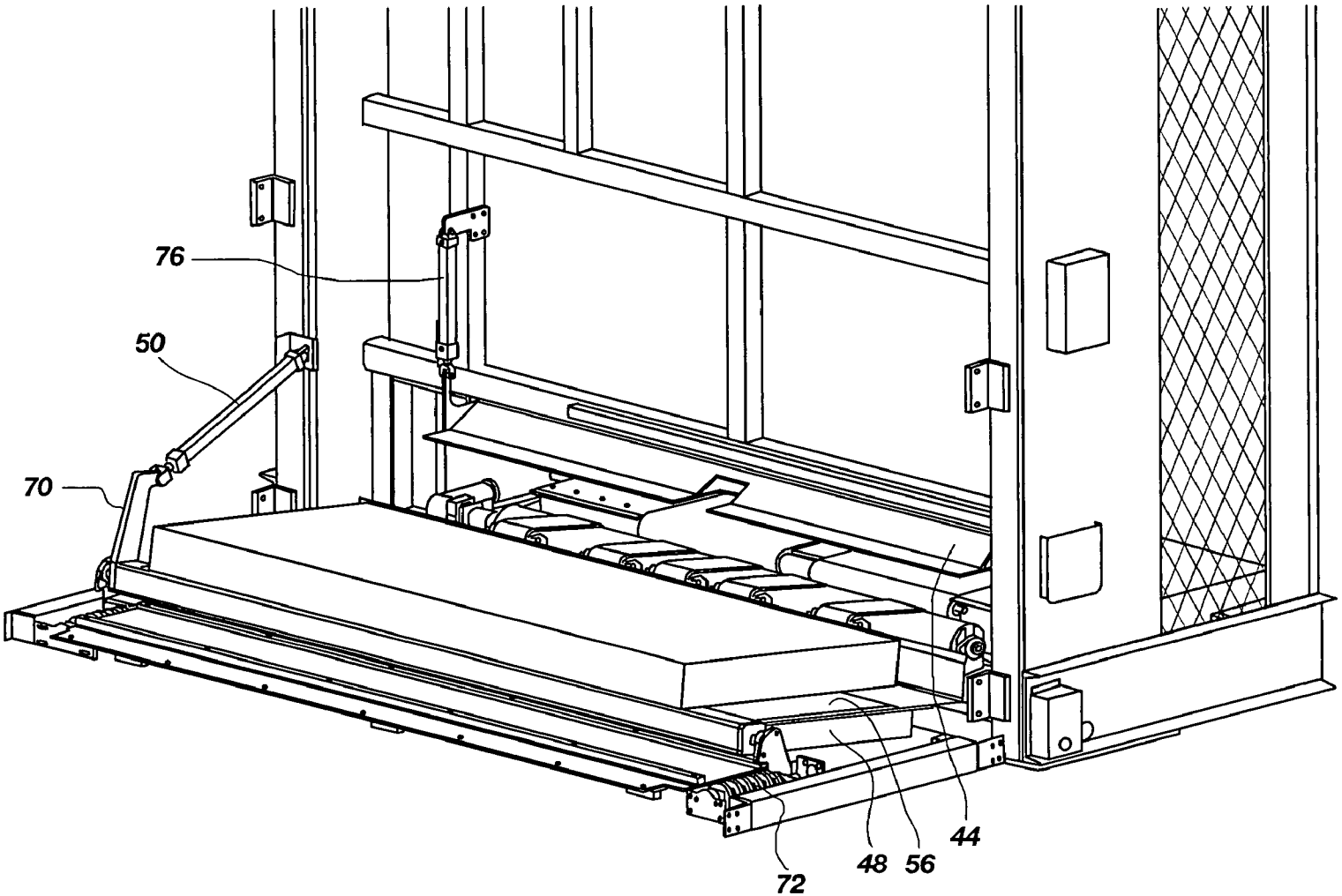
FIG. 4 is a partial isometric view of the prefeeder of FIG. 1 with a an accumulation of waste sheets in the waste sheet tray.

FIG. 4 shows the waste sheet removal mechanism 37 with an accumulation of waste sheets 12 collected on the support surface 56 of the waste sheet tray 48. Retractable gate 44 has been adjusted to an open position to permit the sorting conveyor belts 64 to transport waste sheets from the loading area 34 to the waste sheet tray 48 in the waste sheet area 46. A hydraulic actuator 76 is provided to adjust the gate 44 between the open position of FIG. 4 and a closed position that creates a barrier to prevent non-waste sheets 12 from inadvertently slipping from the loading area 34 to the waste sheet area 46, or getting caught or lodged between the loading area and the waste sheet area before the waste sheets are moved by the sorting conveyor 42.

Figure 5:
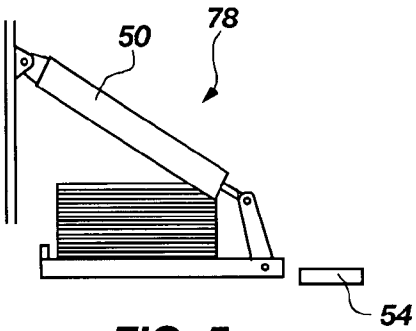
FIG. 5 is a partial side elevation view of the sheet removal mechanism of the prefeeder of FIG. 2 with the waste sheet tray in a lowered horizontal orientation.

FIGS. 5 and 6 show the tilting mechanism 78 used to move the waste sheets 12 to an on-end vertical orientation for convenient removal from the prefeeder 10. In FIG. 5, the tilting mechanism is in a position for accumulating and retaining waste sheets as they are sorted out. The support surface 56 of the waste sheet tray 48 is generally horizontal. In FIG. 6, the actuator 50 has been extended to rotate the waste sheet tray 48 about its pivot axis 52 to a generally vertical orientation. The waste sheets 12 are thereby tilted to their on-end orientation and are dumped on to the exit conveyor 54. The sheets 12 are maintained in the upright on-end orientation by the vertical waste sheet tray 48 on one side and by a wall 74 of the prefeeder 10. The wall 74 may be part of the exterior cover of the prefeeder 10, or may be a separate part provided specifically to help maintain the sheets 12 in the on-end orientation. The tilting mechanism 78 is connected to the interlock 33 on the access door 30 in order to prevent the door 30 from being opened when the waste sheet tray 48 is in the lowered horizontal position of FIG. 5. A safety rated limit switch 80 may be used to sense when the waste sheet tray 48 is in the raised vertical position of FIG. 6, such that the waste sheet access door 30 may be opened.

A method of removing waste sheets 12 from a prefeeder 10 according to one embodiment of the present invention proceeds as follows. When the lift platform 36 has had all of the sheets from the large stack 18 transferred to the output conveyor 24, except for the bottom few waste sheets, the lift platform 36 is moved back to the lowered position of FIG. 2, adjacent to the sorting conveyor 42. The return of the lift platform 36 to the lower position triggers the actuator 76, which raises gate 44.

Sorting conveyor 42 then sorts out the waste sheets by conveying the remaining sheets still on the lift platform 36 over to the waste sheet area 46 and into the waste sheet tray 48, as shown in FIGS. 4 and 6. The waste sheet tray 48 and its actuator 50 are preferably connected to the gate 44, such that if the waste sheet tray 48 is in the raised vertical position, the gate 44 will be electrically or physically locked out so that it remains in the closed position to prevent the transport of waste sheets 12 into the waste sheet area 46 when the waste sheet tray 48 is in the raised position.

The process is repeated several times and waste sheets 12 accumulate in the waste sheet tray 48. As the sheets accumulate in the waste sheet tray 48, sensor 55 eventually senses that the waste sheet tray 48 is full. Indicator 57 is thereby triggered to alert a user 82 that the waste sheet tray 48 is full. The tilting mechanism 78 may be triggered automatically when the waste sheet tray 48 is sensed as full, or may be triggered manually by a user.

The tilting mechanism 78, having been triggered, then causes the actuator 50 to extend, and thereby rotate the waste sheet tray 48 to the vertical orientation of FIG. 6. The waste sheets 12 are also tilted to a vertical orientation and are loaded onto the exit conveyor 54 in an on-end position. Once the waste sheet tray 48 is in the vertical orientation, the limit switch 80 is trigger, which permits waste sheet access door 32 to be opened by a user.

Figure 7:
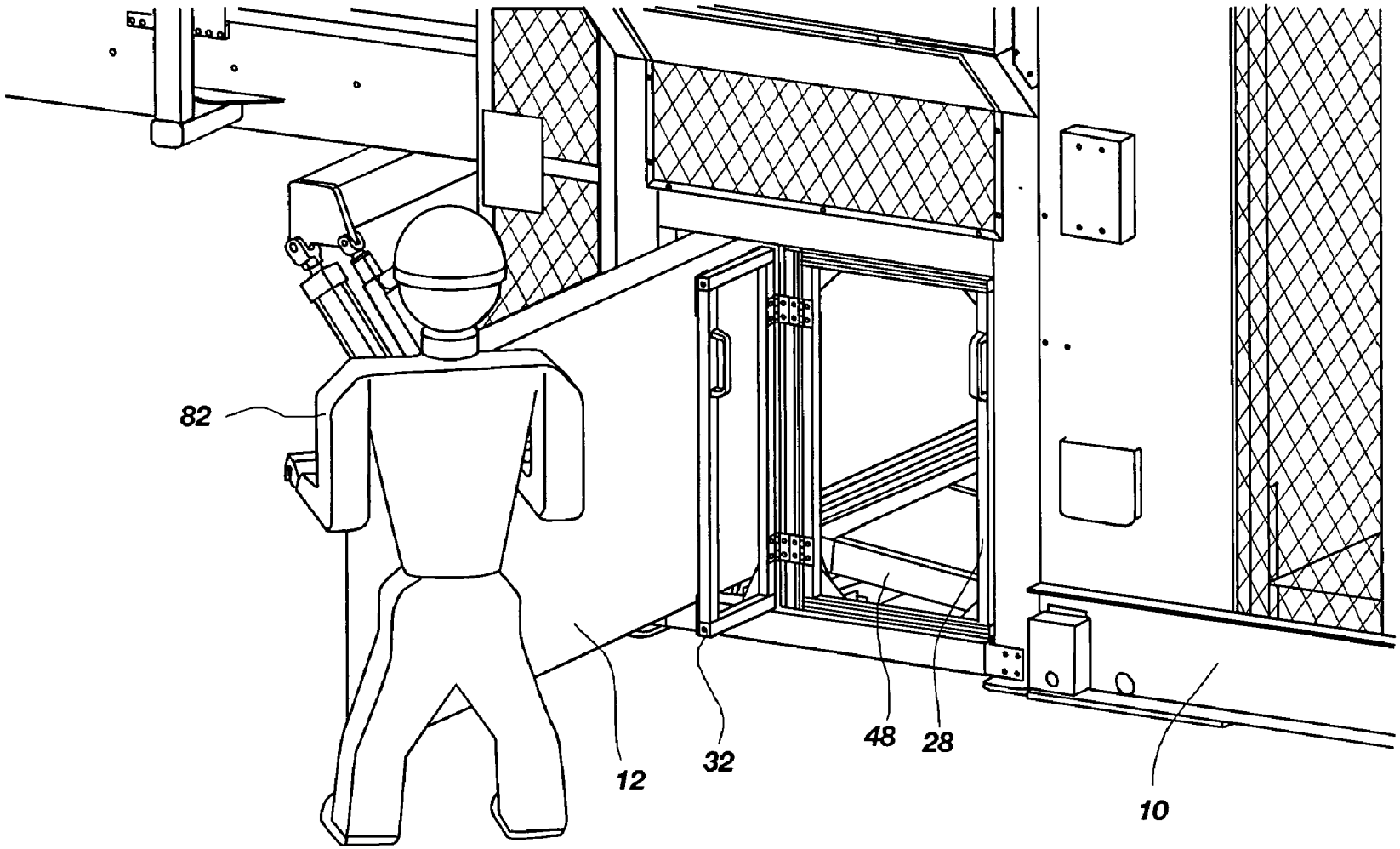
FIG. 7 is a partial isometric view of the prefeeder of FIG. 1 with a stack of waste sheets being removed by a user

A user may open the waste sheet access door 32 and remove the on-end waste sheets through the waste sheet opening 30. Preferably, the exit conveyor 54 will be triggered by the opening of the waste sheet access door 32 and will run for a short period of time to partially extend the on-end waste sheets 12 out of the prefeeder 10, as shown in FIG. 7. The user may then easily and conveniently remove the waste sheets 12 completely from the prefeeder 10 so that they may be disposed. It should be appreciated that a significant advantage of the present invention derives from flipping the waste sheets 12 to the on-end orientation and this advantage could be realized without the exit conveyor 54. For example, the exit conveyor 54 could be replaced by rollers or a smooth relatively low-friction surface.

After a user removes the waste sheets 12 and shuts the waste sheet access door, the waste sheet tray 48 returns to the lowered position of FIG. 5, so that is it ready to accumulate more waste sheets.

When the waste sheet tray 48 is in the raised vertical position of FIG. 6, the large stack 18 will not be permitted into the loading area 34. However, the lift platform 36 and pushrod 40 will continue to load small stacks 22 onto the output conveyor 24 until the lower most sheets in the current large stack 18 are all that remain. At that point, the lift platform 36 will lower. If the waste sheet tray 48 has been returned to the lowered position, the waste sheets on the lift platform 36 will be sorted to the waste sheet tray 48, a new large stack 18 will be loaded onto the lift platform 36, and the process will continue automatically. If, however, the waste sheet tray is in the raised vertical position when the lift platform returns to its lowered position, the prefeeder will switch to manual mode, and will not feed any additional sheets 12 until the user has initiated the automatic mode after the waste sheet tray has been lowered to the horizontal position of FIG. 5.

Therefore it can be seen that the present invention provides a method and apparatus that permits the convenient, safe, efficient and ergonomic removal of waste sheets from a sheet feeding apparatus.

Although various representative embodiments of this invention have been described above with a certain degree of particularity, those skilled in the art could make numerous alterations to the disclosed embodiments without departing from the spirit or scope of the inventive subject matter set forth in the specification and claims. All directional references (e.g., upper, lower, upward, downward, left, right, leftward, rightward, top, bottom, above, below, vertical, horizontal, clockwise, and counterclockwise) are only used for identification purposes to aid the reader 's understanding of the embodiments of the present invention, and do not create limitations, particularly as to the position, orientation, or use of the invention unless specifically set forth in the claims. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other.

In some instances, components are described with reference to "ends" having a particular characteristic and/or being connected with another part. However, those skilled in the art will recognize that the present invention is not limited to components which terminate immediately beyond their points of connection with other parts. Thus, the term "end" should be interpreted broadly, in a manner that includes areas adjacent, rearward, forward of, or otherwise near the terminus of a particular element, link, component, part, member or the like. In methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

I claim:

1. A waste sheet removal mechanism for removing waste sheets from a prefeeder, the waste sheet removal mechanism comprising a tilting mechanism for tilting the waste sheets to an on-end orientation such that they may be removed from the prefeeder in the on-end orientation and an exit conveyor configured to convey the waste sheets at least partially out of the prefeeder in the on-end orientation, wherein the tilting mechanism comprises a waste sheet tray having a generally horizontal orientation for accumulating the waste sheets and a generally vertical orientation for dumping any accumulated waste sheets onto the exit conveyor in the on-end orientation, and an actuator for moving the waste sheet tray between the generally horizontal orientation and the generally vertical orientation about a pivot axis, wherein the exit conveyor is located below and adjacent to the pivot axis, such that when the waste sheet tray is pivoted to the substantially vertical orientation, any accumulated waste sheets are dumped on to the exit conveyor in an on-end orientation.

2. The waste sheet removal mechanism of claim 1, wherein the actuator is a hydraulic actuator.

3. The waste sheet removal mechanism of claim 1, further comprising a detector for sensing when the waste sheet tray is full and a signal for signaling when the waste sheet tray is full.

4. The waste sheet removal mechanism of claim 3, wherein said tilting mechanism is activated by a signal from the detector when the waste sheet tray is full, from the generally horizontal orientation to the generally vertical orientation.

5. A waste sheet removal mechanism for removing waste sheets from a prefeeder, the waste sheet removal mechanism comprising a tilting mechanism for tilting the waste sheets to an on-end orientation such that they may be removed from the prefeeder in the on-end orientation, and an exit conveyor configured to convey the waste sheets at least partially out of the prefeeder in the on-end orientation, wherein the tilting mechanism comprises a waste sheet tray having a first orientation for accumulating the waste sheets and a second orientation for dumping any accumulated waste sheets onto the exit conveyor in the on-end orientation, and an actuator for moving the waste sheet tray between the first orientation and the second orientation about a pivot axis, wherein the exit conveyor is located below and adjacent to the pivot axis, such that when the waste sheet tray is pivoted to the second orientation, any accumulated waste sheets are dumped on to the exit conveyor in an on-end orientation.

6. The waste sheet removal mechanism of claim 5, wherein the actuator is a hydraulic actuator.

7. The waste sheet removal mechanism of claim 5, further comprising a detector for sensing when the waste sheet tray is full and a signal for signaling when the waste sheet tray is full.

8. The waste sheet removal mechanism of claim 7, wherein said tilting mechanism is activated by a signal from the detector when the waste sheet tray is full, from the first orientation to the second orientation.

9. A waste sheet removal mechanism for removing waste sheets from a prefeeder, the waste sheet removal mechanism comprising a tilting mechanism for tilting the waste sheets to an on-end orientation such that they may be removed from the prefeeder in the on-end orientation, and an exit conveyor configured to convey the waste sheets at least partially out of the prefeeder in the on-end orientation, wherein the tilting mechanism comprises a waste sheet tray having a first orientation for accumulating the waste sheets and a second orientation for dumping any accumulated waste sheets onto the exit conveyor in the on-end orientation, and an actuator for moving the waste sheet tray between the first orientation and the second orientation about a pivot axis, wherein said waste sheet tray comprises a support surface and a retaining lip disposed generally along an edge of the waste sheet tray, wherein in the first orientation the support surface is sloped downwardly towards the retaining lip.

10. The waste sheet removal mechanism of claim 9, wherein the first orientation is a generally horizontal orientation.

11. The waste sheet removal mechanism of claim 10, wherein the second orientation is a generally vertical orientation.

12. The waste sheet removal mechanism of claim 9, wherein the actuator is a hydraulic actuator.

13. The waste sheet removal mechanism of claim 9, further comprising a detector for sensing when the waste sheet tray is full and a signal for signaling when the waste sheet tray is full.

14. The waste sheet removal mechanism of claim 9, wherein said tilting mechanism is activated by a signal from the detector when the waste sheet tray is full, from the first orientation to the second orientation.

* * * * *